United States Patent [19]

Scherf et al.

[11] 3,991,546

[45] Nov. 16, 1976

[54] DOUBLE-TWIST APPARATUS

[75] Inventors: Siegfried Scherf; Aloys Greive, both of Munster, Germany

[73] Assignee: HAMEL GmbH Zwirnmaschinen, Munster, Germany

[22] Filed: Nov. 7, 1975

[21] Appl. No.: 630,074

[30] Foreign Application Priority Data

July 11, 1974 Germany ..... 2452939
Sept. 15, 1975 Germany ..... 291644[U]

[52] U.S. Cl. ..... 57/80; 57/89; 57/135

[51] Int. Cl.[2] ..... D01H 7/22; D01H 7/12; D01H 13/16

[58] Field of Search ..... 57/129, 130, 135, 78, 57/80, 81, 88, 89

[56] References Cited

UNITED STATES PATENTS

| | | | |
|---|---|---|---|
| 1,471,292 | 10/1923 | Sloat | 57/80 |
| 2,252,037 | 8/1941 | Schaum | 57/89 |
| 2,786,324 | 3/1957 | Keith et al. | 57/80 X |
| 3,640,144 | 2/1972 | Eckholt | 57/89 X |
| 3,645,084 | 2/1972 | Nimtz | 57/88 |

*Primary Examiner*—John Petrakes
*Attorney, Agent, or Firm*—Karl F. Ross; Herbert Dubno

[57] ABSTRACT

A double-twist apparatus has a support provided with a journal in which is rotatably received a sleeve having an eccentric bore in which is centered the shaft of a twist spindle. A whorl carried on the shaft is engageable with a flat belt and rotation of the eccentric spindle within the fixed journal can move the whorl into and out of engagement with the belt. A lever is provided on the sleeve for angular displacement of this sleeve and a spring normally urges the sleeve into a position corresponding to engagement of the whorl with the belt or disengagement of the two. In the case of the spring urging the sleeve into the engaged position a toggle linkage is provided to hold the device in this position. In the arrangement where it urges the whorl away from the belt a spring-loaded device operated by a thread-tension sensor downstream of the apparatus is provided to stop the device in case of thread rupture. A brake is provided on the spindle shaft to arrest it when it is swung out of engagement with the belt.

20 Claims, 7 Drawing Figures

DOUBLE-TWIST APPARATUS

CROSS-REFERENCE TO RELATED APPLICATION

This application is related to our copending and commonly filed patent application Ser. No. 630,075, filed Nov. 7, 1975.

FIELD OF THE INVENTION

The present invention relates to a filament twisting apparatus. More particularly this invention concerns a spindle for supporting a yarn package in such an apparatus.

BACKGROUND OF THE INVENTION

A twisting apparatus is known having a support beam on which is mounted a plurality of upright spindles each shaped to carry a respective yarn package from which a filament is pulled and wound up on a takeup spool. The spindles are vertical and each has a whorl engageable with a flat belt that drives the spindle at a high rotation speed that, in conjunction with the speed with which the filament is pulled off the yarn package, determines the extent of twist given the filament. Means is provided to displace each of the spindles away from the belt in order to allow the yarn package carried on the spindle to be replaced or the spinning operation to be stopped when the takeup spool has the desired quantity of filament on it. In addition in case the thread breaks it is necessary to stop the yarn package in order to repair the break.

Typically the spindles are arranged on a pivotal arm such as described in German Gebrauchsmuster No. 6,935,778. The typical arrangement simply has a spring-loaded arm pivoted on the apparatus support and carrying on its free end the spindle, with the spring effective to press the whorl on the spindle against the drive belt. A handle along with locking mechanism is provided so that the arm can be swung around and held in a position with the whorl spaced from the belt. Such arrangements have proven themselves a considerable advantage over systems wherein a magnetic clutch disconnects the package-carrying part of the spindle from the whorl part. In addition such arrangements have proven themselves superior to the systems where the belt is merely pushed away from the spindle by means of a roller or the like, as such devices invariable stretch the belt and eventually require its replacement. Other arrangements are known which merely lock the spindle so that the belt rubs on it without rotating it. Such arrangements are extremely simple, but lead to advanced belt wear and frequently damage the spindle over which the belt is riding.

The principal disadvantage, however, of the pivotal-arm arrangements is that they are relatively bulky and frequently difficult to clean. The spinning process generates a great deal of lint so that the apparatus must be cleaned regularly in order to assure its proper functioning, and cleaning of the interstices of the pivotal arm is relatively difficult. Furthermore the bulkiness of the swinging-arm arrangement reduces the amount of yarn packages that can hold on a given support.

OBJECTS OF THE INVENTION

It is therefore an object of the present invention to provide an improved spinning apparatus.

Another object is the provision of such an apparatus which is easy to clean and very compact.

SUMMARY OF THE INVENTION

These objects are attained according to the present invention in a filament-spinning apparatus of the above-described general type, but wherein the yarn-package supporting spindle is rotatable in an eccentric bore in a sleeve which is rotatable in the support about a main axis offset from the axis of the eccentric bore. Means is provided for displacing the sleeve angularly about the main axis, thereby displacing the rotation axis of the spindle, so as to put the whorl on the spindle into or out of contact with the drive belt moving continuously past the support.

According to a feature of the present invention the sleeve is biased into the operating position with the whorl pressing against the belt, and a detent is provided for releasably retaining the sleeve in this operating position. This dentent may include a ball radially engageable with a formation or recess of the sleeve and pressed by means of a spring toward the sleeve. The sleeve is formed with a peripheral outwardly open groove and the spring normally presses the ball radially inwardly into this groove. The groove is formed with a recess that determines the detent position.

In accordance with another feature of this invention a toggle linkage is provided with a hand-operable lever in order to switch the spindle between the operative and rest positions. This linkage includes a spring-loaded telescoping element having one end pivoted on the sleeve and other end pivoted on the knee or hand-operable lever for angularly displacing the sleeve. The compression device is set up so as to be under maximum compression in a metastable position of the lever arm intermediate two stable end positions. The spring-loaded telescoping device is provided between the handle and the support.

According to yet another feature of this invention the spring biasing of the sleeve into the operative position is sufficiently strong to displace the toggle out of its corresponding stable end position. Thus the operator need merely release the handle after he or she has repaired the broken thread or put a new yarn package on the spindle. Thus it is possible to provide a single stop in the detent means, corresponding to the operating position. When the above-described toggle linkage is used, however, usually two end stop positions are provided.

According to yet another feature of this invention, the spinning apparatus is provided with a takeup spool for winding up the filament pulled off the yarn package on the spindle, and with means for detecting when the takeup spool has achieved a predetermined diameter and/or when the thread between the takeup spool and the yarn package on the spindle is no longer taut. The detector generates an output when the spool has reached a predetermined diameter and/or when the thread is no longer taut, and this output is employed to switch the spindle automatically from the operative to the rest position. The device may thus be stopped automatically when the thread breaks, when the yarn package on the spindle is depleted, or when the takeup spool has achieved the desired size. The mechanism switching over the spindle may comprise a simple rotary or linear-acting solenoid, or a single- or double-acting pneumatic or hydraulic cylinder. In system with no toggle linkage giving a pair of end stable positions, but merely with a spring urging the device constantly into the operative position, the remotely controllable mechanism is effective only to pull the sleeve into the rest position. When released the spindle automatically returns to the operative position.

It is also within the scope of this invention to continuously urge the spindle into the rest position, and use the mechanism connected to the thread-tension sensor or takeup spool measurer to hold the sleeve in the operative position when necessary. Of course the device may also be provided with means for measuring the amount of filament wound up, or means for automatically stopping the arrangement when a predetermined marking has been visually detected on the filament.

According to this invention the thread-tension sensor may be a two-arm lever having one long arm extending generally horizontally and riding on an inclined stretch of the filament between the yarn package and the takeup spool. With a given tautness this arm will therefore lie at a given angle to the horizontal. The other arm of the lever is connected via a Bowden cable or the like to the spindle to the sleeve-displacing mechanism. In accordance with a further feature a catch may be provided to hold the spindle in the operative position, with the sleeve being continuously biased into the rest position. When the two-arm lever pivots due to a sudden decrease in thread tension as occurs when the thread ruptures or the yarn package on the spindle is depleted, the catch releases the sleeve and allows it to swing into the rest position.

According to further features of the present invention there is provided a brake engageable with the spindle to arrest it when it is moved into the rest position. This brake may comprise a pair of jaws pivoted to one side of the spindle and spring biased against the spindle. Means is provided on the mechanism for changing spindle position to normally hold these brake shoes away from the spindle, but to allow them to engage the spindle when moved into the rest position. In order to prevent premature reaction of this apparatus a lost-motion coupling is provided in the switchover mechanism. This coupling may be formed by means of a slit in the two-arm lever in which is engaged the end of the Bowden cable, whereby the lever only moves the Bowden cable after it has been swung through an angle corresponding to a relatively great decrease in tension.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
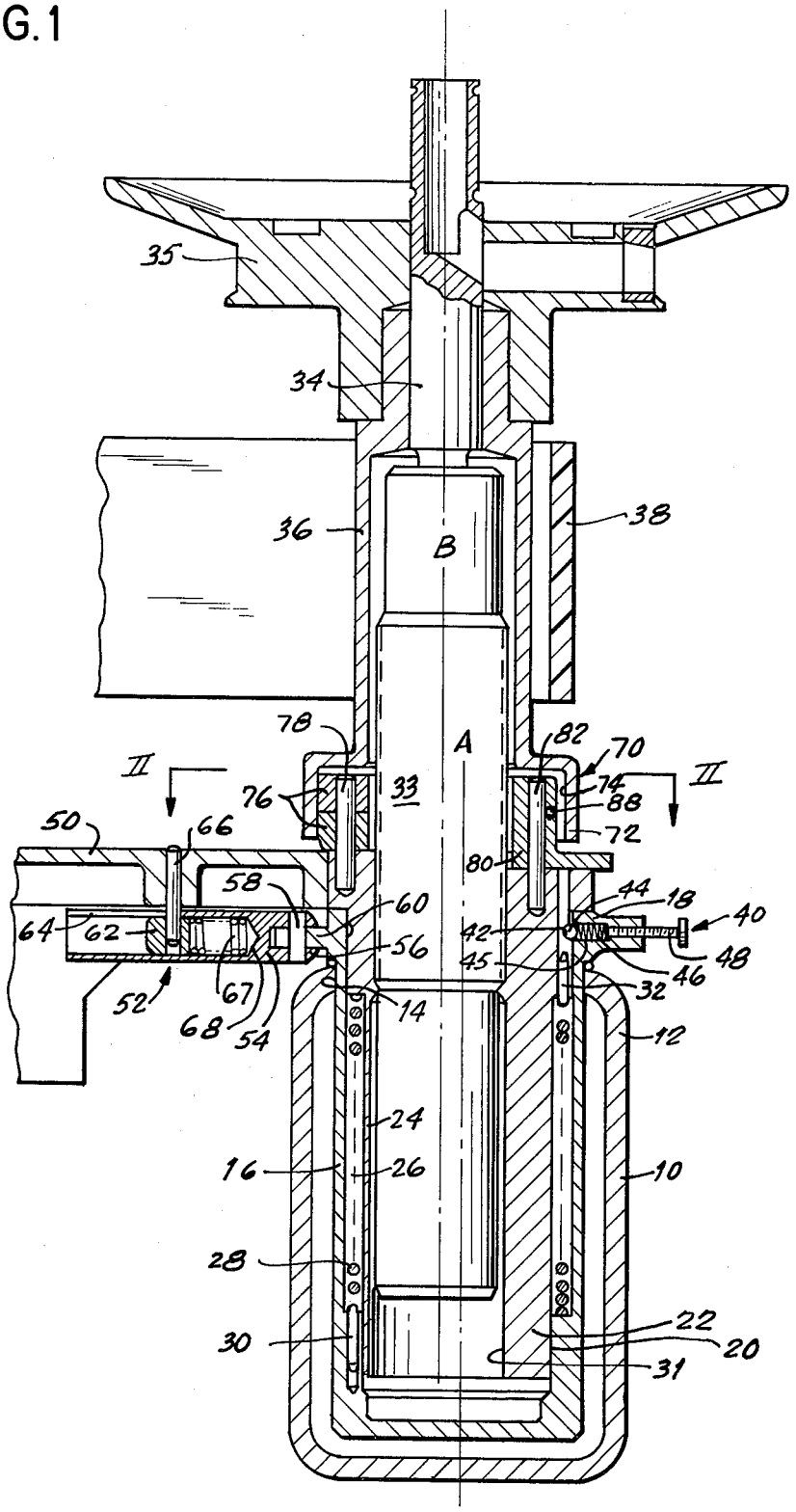
FIG. 1 is a vertical section through an apparatus according to this invention.
Figure 2:
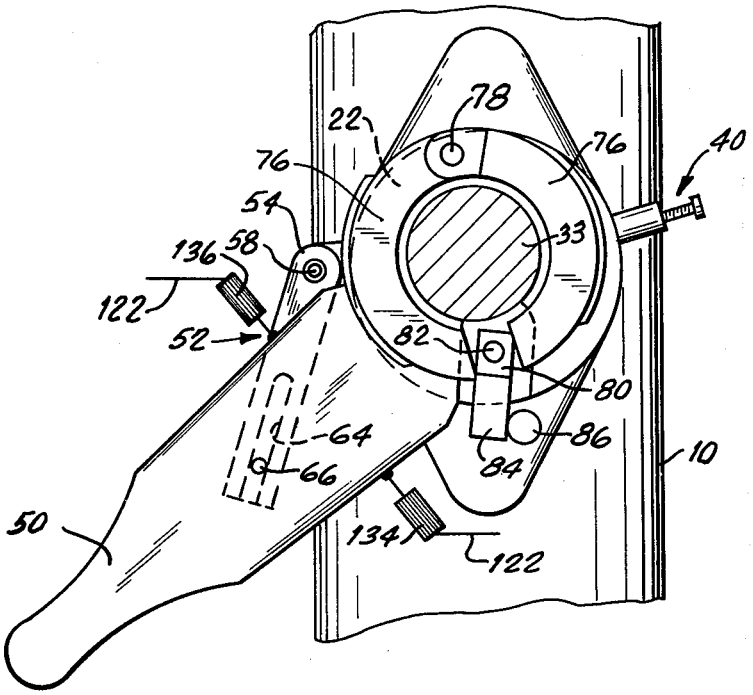
FIG. 2 is a section taken along line II—II of FIG. 1.
Figure 3:
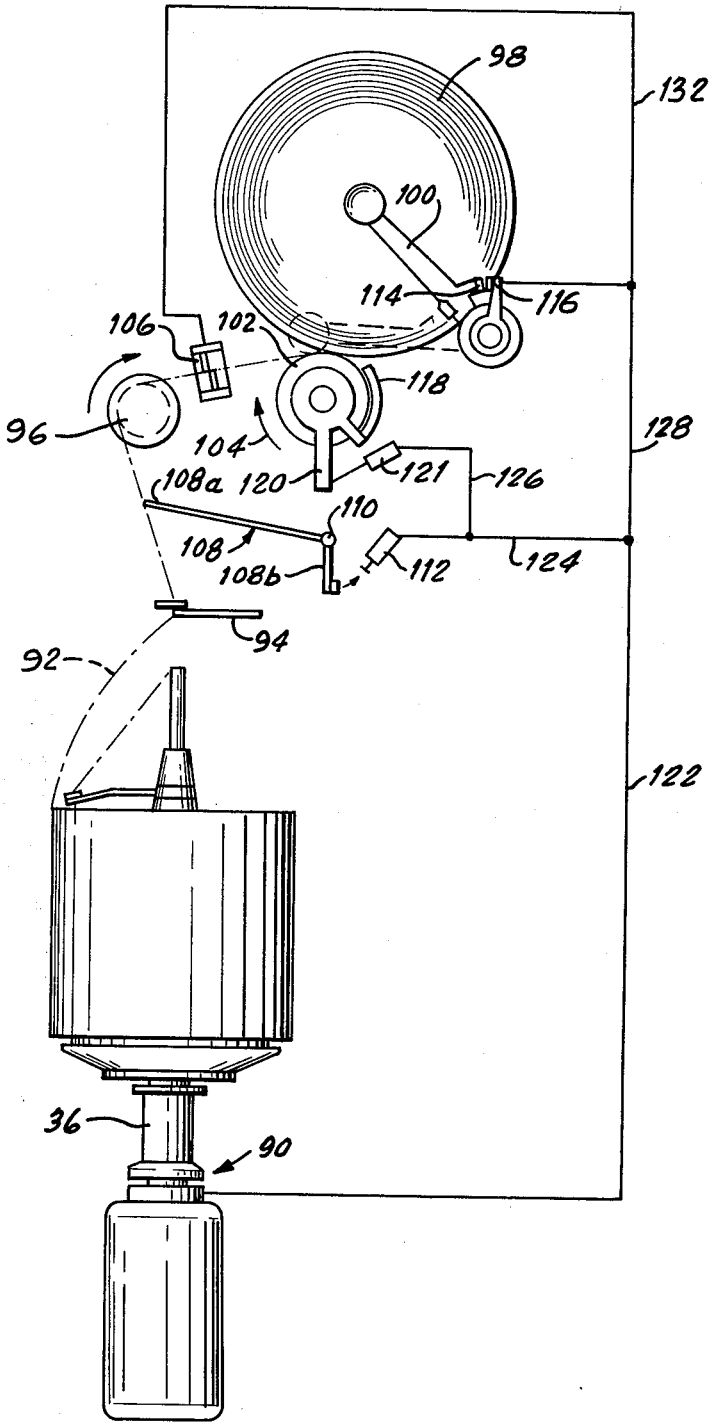
FIG. 3 is a largely diagrammatic view illustrating the spinning system usable with the apparatus of FIG. 1.
Figure 4:
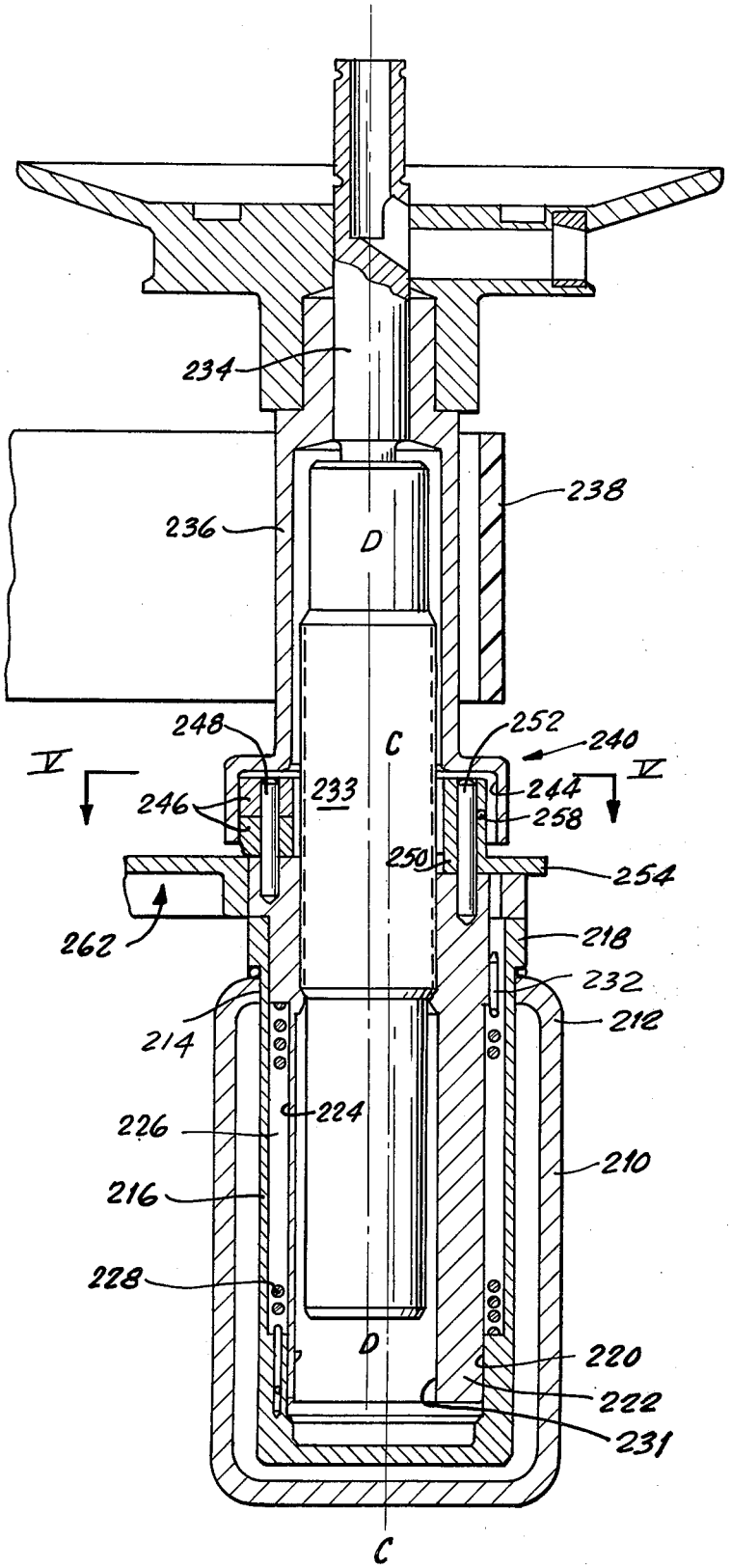
FIG. 4 is a view similar to FIG. 1 through another spinning apparatus in accordance with this invention.

FIGS. 1–3 show an apparatus having a support beam 10 whose upper side 12 is formed with a hole 14 in which is seated a cup-like journal 16. The rim 18 of this bearing 16 rests on the side 12 and is secured thereto by screws. Bearing 16 has a central bore 20 having a central axis A. An eccentric sleeve 22 is journaled within the bore 20 and has on its outside a groove 24 which forms with the bore 20 an annular chamber 26 in which is provided a torsion spring 28 having one end 30 seated in the journal 16 and the other end 32 in the sleeve 22.

The eccentric sleeve 22 has an eccentric bore 31 defining an axis B offset from the axis A. A journal 33 is secured within the eccentric sleeve 22 and carries a spindle 34 rotatable about the axis A and serving as a double-filament twist spindle. A whorl 36 is secured to the shaft 34 as well as a yarn-package support 35. Rotation of the sleeve 22 about the axis A displaces the axis B so as to move the whorl 36 closer or further away from a flat drive belt 38. The torsion spring 28 is adapted to rotate the sleeve 22 in a direction tending to move the whorl 36 against the belt 38.

A detent arrangement 40 is provided for defining at least one end position for the sleeve 22. This arrangement 40 has a ball 44 urged by a spring 46 into a circumferential groove 42 around the sleeve 22. The ball 44 rides in a radially extending hole 45 in the journal 16 and a screw 48 is provided to vary the compression of the spring 46. The groove 42 is formed with a recess that is aligned with the ball 44 at the location across from this ball 44 when the sleeve 22 is in the operative position.

The sleeve 22 is pivoted about its axis indicated in FIG. 2 by means of a lever 50 intended to be operated by the knee of the machine operator. The toggle linkage 52 is provided between the journal 16 and the lever 50, and comprises a sleeve 54 having a forked end 56 connected by a pin 58 to an eye 60 on the journal 16. This sleeve 56 is provided internally with a slider 62 urged away from the eye 60 by means of a compression spring 67 and transfixed by a pin 66 engaged in a slot 64 and seated in the lever 50.

In FIG. 2 the lever 50 is shown in the rest position, that is the position in which the whorl 36 is the furthest from the belt 38. In order to switch over to the operative position with the whorl 36 engaging against the belt 38, the handle 50 is swung clockwise so as to compress the spring 67 and move the linkage 52 beyond its metastable point, that is with the cylinder 54 extending generally parallel to the lever 50 and with the spring 67 at maximum compression.

The arrangement shown in FIGS. 1 and 2 has a brake 70 formed by a cylindrical extension 72 of the whorl 36 that has an internal surface 74 engageable by two arcuate brake shoes 76 jointly pivoted at a pin 78 on the nonrotatable journal 16. Between the other ends of the arcuate shoes 76 there is provided a spreading member 80 which is pivoted diametrically opposite the pin 78 on a pin 82 in the journal 16. The spreading member 80 has an actuating arm 84 engageable with a pin 86 on the journal 16, and simultaneously serving as an end stop for the arrangement in the operative position.

When the arm 50 is swung counterclockwise the eccentric sleeve 22 also moves in this direction and the spreader strikes the abutment 86 and pries the end of the shoes 76 apart so as to press them outwardly against the force of a spring 88 against the inside surface 74 of the braking portion 72, thereby arresting the parts 34–36.

FIG. 3 shows a double-twist spindle 90 having the spindle whorl 36 seen in FIG. 1. A filament 92 is pulled off the double-twist spindle 90 and pulled through a guide eye 94 and over a deflecting roller 96 to a windup spool 98. This spool 98 is carried on a pivot pin at the end of a pivotal arm 100. The spool 98 radially engages a drive roller 102 which is driven by means of a motor in the direction of arrow 104. The arm 100 carries a grounded contact 114 which is engageable with a live fixed contact 116 when the spool 98 has a diameter corresponding to the desired size.

The filament 92 is engaged by a tension-detector lever 108 having one arm 108*a* engageable with the thread and another arm 108*b* engageable with a microswitch 112 when the filament ruptures. A solenoid 121 is connected via an arm 120 to an arcuate plate 118 that can be swung between the drive roller 102 to stop the spool 98 from rotating. In addition a thread-cutting arrangement 106 is provided between the deflecting roller 96 and the takeup spool 98. Conductors 122, 124, 126, 128, 130 and 132 form a control network which connects these various elements and the actuators 134 and 136 on opposite sides of the arm 150 together.

The device functions as follows:

Under normal circumstances the actuators 134 and 136 hold the arrangement in the operating position so that the belt 38 spins the shaft 36 and the motor rotates the takeup spool 98 to pull the filament 92 off the yarn package and wind it up. The spring-loaded solenoid 121 is relaxed so that the plate 97 is not between the roller 102 and the takeup spool 98, and the arm 108a is lifted so the switch 112 is opened.

Whenever the contacts 114 and 116 engage each other, indicating that the spool 98 has the desired diameter, either or both of the actuators 134 and 136 are operated to move the arrangement into the rest position and simultaneously to operate the cutting device 106 and the solenoid 121 to cut off the filament 92 and stop rotation of the spool 98. The operator may at this time replace the spool 98 with an empty core to which he attaches the end of the filament 92. This opens the contacts 114 and 116 and allows the device again to be set in operation.

Should the filament break or the yarn package on the spindle be depleted the switch 112 will be closed and the solenoid 121 operated to stop rotation of the roller 98 and the actuators 134 and 136 similarly operated to cease rotation of the whorl 36 by the belt 38. The break is repaired or the package replaced and operation can be started up again as described above.

FIGS. 4–7 show an arrangement having a support 210 whose upper edge 212 is formed with the hole 214 in which is received a journal 216 whose upper rim 218 is bolted to the upper wall 212. There is received in the cylindrical bore 220 of the journal 216 an eccentric sleeve 222 having on its outer periphery a groove 224 which forms a chamber 226 with the bore 220. A torsion spring 228 is received within the chamber 226 and has one end 230 secured in the journal 216 and another end 232 anchored in the eccentric sleeve 222.

The eccentric sleeve 222 has an eccentric bore 231 in which is mounted a journal sleeve 233 in which in turn is mounted a spindle shaft 234 adapted to support a yarn package. On the spindle shaft 234 there is formed a whorl 236 engageable and drivable by a flat belt 238. Rotation of the eccentric sleeve 222 about its axis C displaces the axis D of the shaft 234 and thereby moves the whorl 236 closer or further away from the drive belt 238. The eccentric sleeve 222 is prestressed rotatably by the spring 228 in a direction tending to displce the whorl 236 away from the belt 238, not toward it as in FIGS. 1–3.

Figure 6:
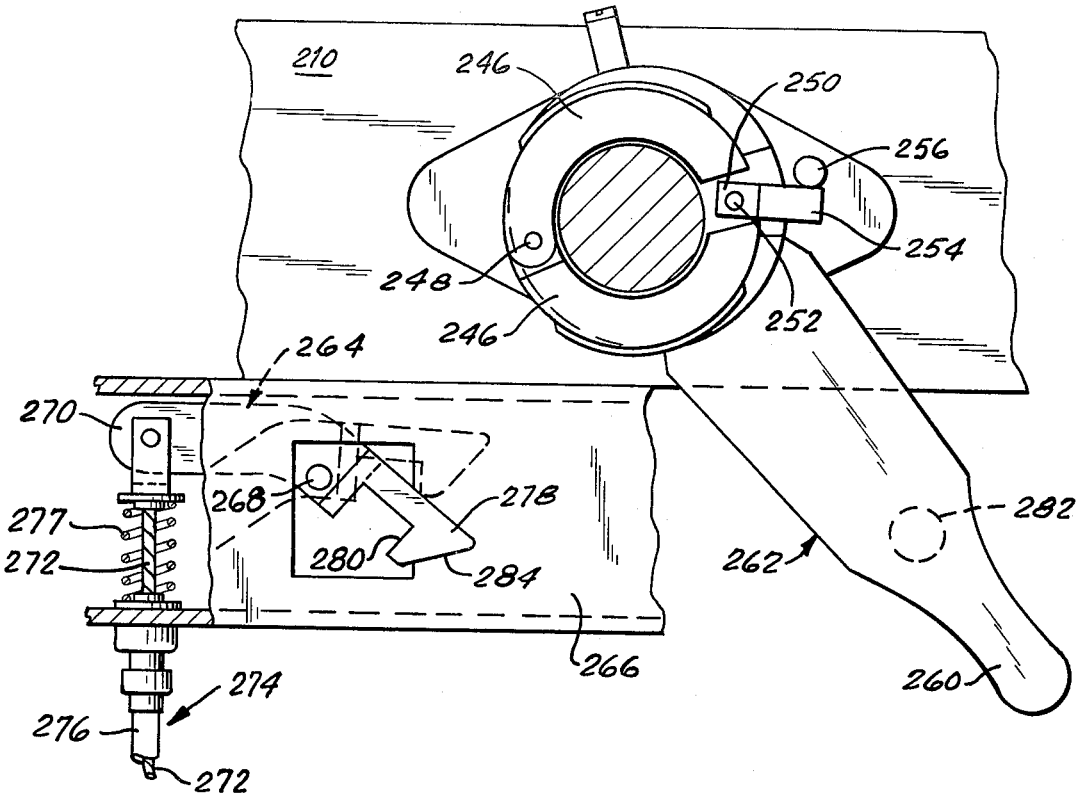
FIG. 6 is a view similar to FIG. 5 illustrating the apparatus in the rest position.
Figure 5:
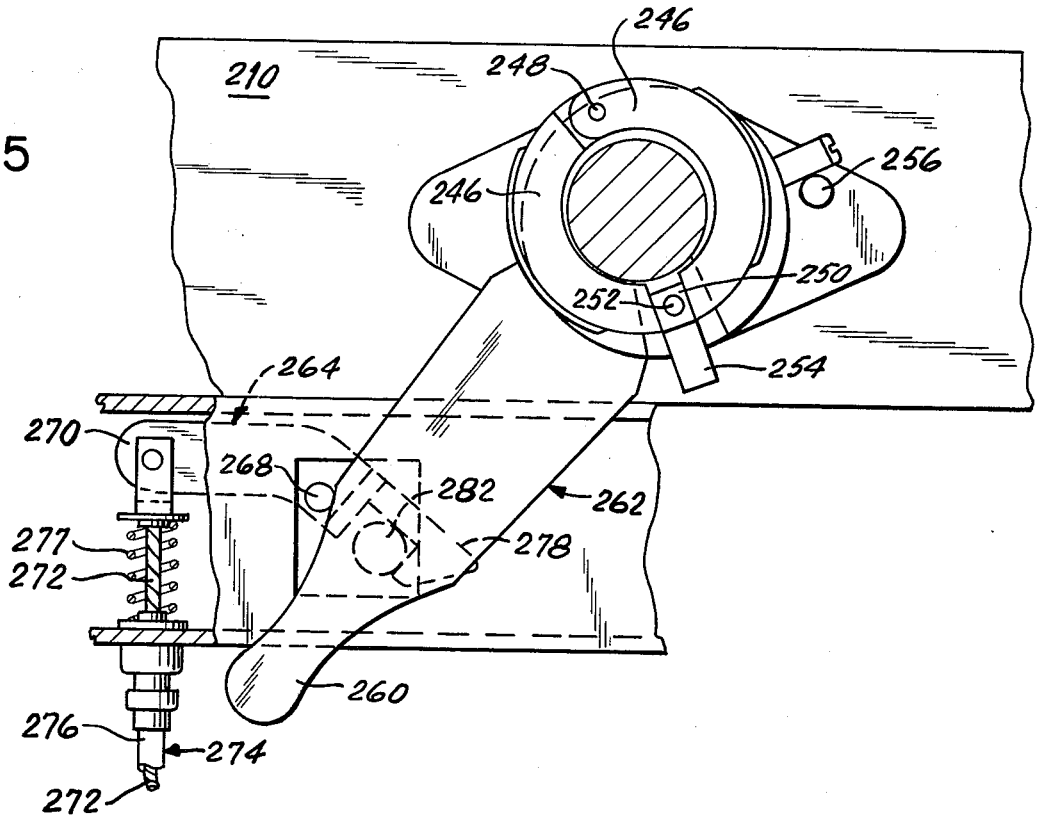
FIG. 5 is a section taken along line V—V of FIG. 4.

In addition the spindle arrangement has a brake shown generally at 240 and comprising a braking surface 242 which forms a downward extension of the whorl 236. Inside this braking element 242 and engageable with the inner surface 244 thereof, are two arcuate brakeshoes 246 each pivoted at one end on a pin 248. Between the other ends of the shoes 246, as shown in FIGS. 5 and 6, there is provided a spreading member 250 pivotal about a pin 252 and having a radially outwardly extending operating arm 254 engageable with a fixed abutment 256.

When the eccentric sleeve 222 is urged by the spring 228 in a counterclockwise direction so as to displace the whorl 236 away from the belt 238 (see FIG. 6) the operating arm 254 strikes the abutment 256 and the spreader 250 separates the two brake shoes 246 against the force of a spring 258 (FIG. 4) to press the brakeshoes 246 against the inner surface 244 of the braking element 242. This rotatably arrests the spindle whorl 236 and the spindle shaft 234 as well as all of the associated parts. The abutment 256 thereby defines with the arm 254 the rest position of the sleeve 222.

An operating lever 262 secured to the sleeve 222 is provided with a hand grip 260 for rotatably displacing the sleeve 222.

In order to secure the eccentric sleeve 222 in its operative position in which the whorl 236 lies against the belt 238 there is provided a pawl indicated generally at 264. This pawl 264 is pivotal about a pin 268 parallel to the spindle axis D and secured in a profile beam 266 secured to the profile support beam 210. On the one end 270 of the two-armed pawl 264 there is connected the core 272 of a Bowden cable 274 whose outer sleeve or jacket 276 secured to the beam 266. A compression spring 277 is engaged between the inner wall of the beam 266 and the end of the core secured to the arm 270 and serves to hold the pawl 264 in the position indicated in solid lines in FIGS. 5 and 6.

The other end 278 of the pawl 264 is formed as a hook with a recess 280 in which is engageable a locking pin 282 carried on the lever 262. Pivoting of the lever 262 out of the position indicated in FIG. 6 into the position indicated in FIG. 5 causes the pin 282 to slide against an inclined or beveled surface 284 of the end 278 of the pawl 264 and allows the pin 282 to snap into the recess 280. When the pawl is pivoted into the position indicated in dashed lines in FIG. 6, however, the pin 282 is freed and the torsion spring 228 may swing the arm 262 back into the position indicated in FIG. 6.

Figure 7:
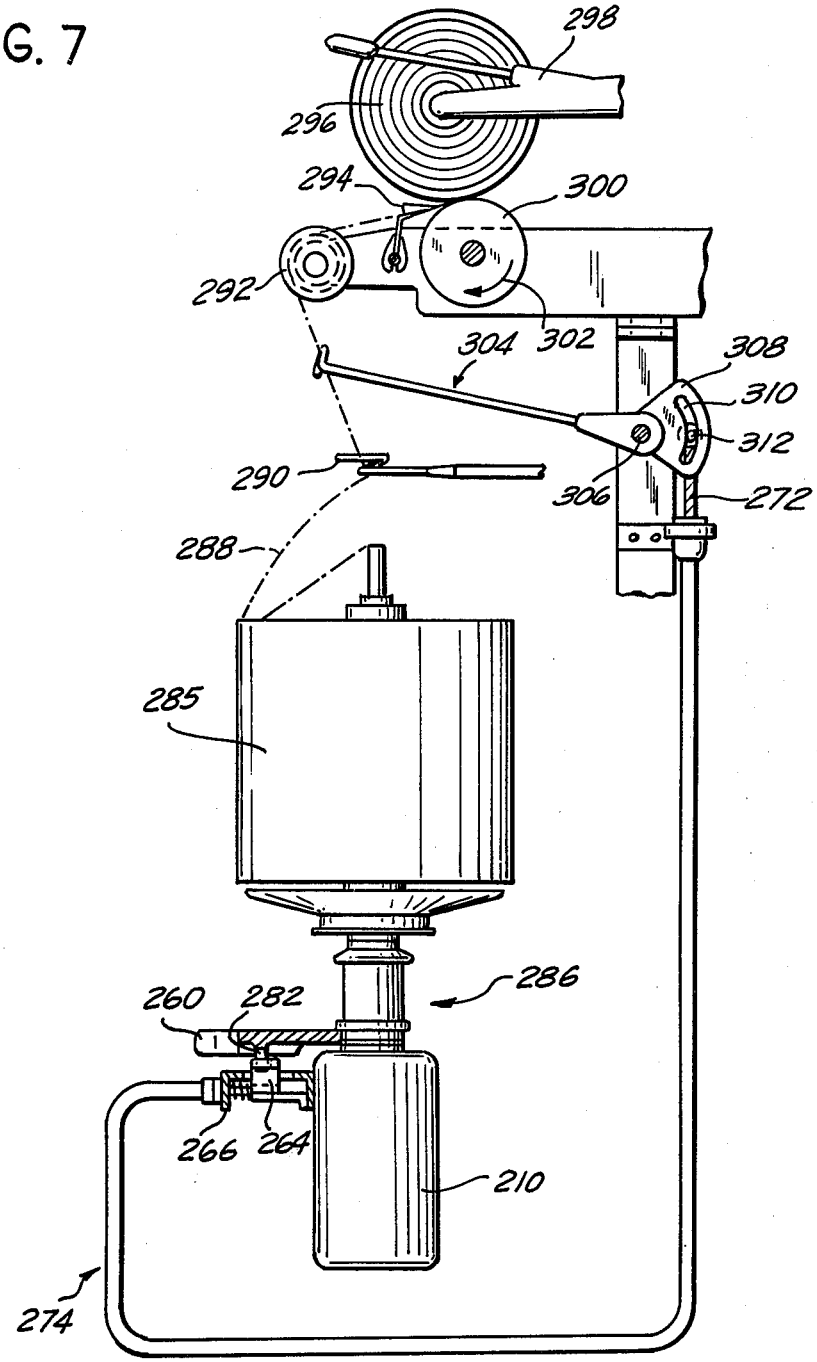
FIG. 7 is a view similar to FIG. 3 illustrating the operation of the apparatus of FIGS. 4–6.

The operating mechanism for the pawl 264 is illustrated in FIG. 7. Here the double-filament spindle 285 whose support is indicated schematically at 286 corresponds to the arrangement shown in FIGS. 4–6. A filament 288 is pulled through a guide 290 from the double-twist spindle 285, passes over a deflecting roller 292 and through another guide 294 to a takeup spool 296. An arm 298 carries the takeup spool 296 and a drive roller 300 normally rotated by a motor in the direction of arrow 302 serves to rotate this spool 296 at a constant peripheral speed.

A thread feeler 304 is provided between the guide 290 and the deflecting roller 292 and is generally formed as a two-armed lever pivotal about a horizontal axis 306. The other arm of this lever 304 is formed as a segment 308 with an arcuate slot 310 centered on the axis 306 and receiving a pin 312 carried by the core 272 of the Bowden cable 274. The length of this slot 310 therefore constitutes a lost-motion coupling so that if the arm 304 pivots excessively about the axis 306 it will pull on the core 272 and release the arm 262 from the position indicated in FIG. to the position indicated in FIG. 6, thereby automatically stopping rotation of the spindle 286. The lost-motion coupling prevents the device from reacting and stopping whenever a minor change in thread tension occurs. The tension in the spring 277 determines the amount of tension necessary to operate the feeler 304. The slot 310 is extended above the pin 312 as well as below it in order to allow the arm 304 to be swung up when the yarn package in the arrangement 285 is changed.

We claim:

1. A filment-spinning apparatus comprising:

a support having a cylindrical bore defining a main axis, a sleeve rotatable in said bore about said main axis and having an eccentric bore centered on an eccentric axis parallel to and offset from said main axis, a spindle rotatable in said eccentric bore about said eccentric axis, a belt continuously displaceable past said support, a whorl on said spindle adjacent said belt, means for displacing said sleeve angularly about said main axis between an operating position with said whorl engaging and driven by said belt and a rest position with said whorl spaced from and out of engagement with said belt, and means on said spindle for supporting a yarn package thereon.

2. The apparatus defined in claim 1, further comprising biasing means between said sleeve and said support for urging same into said operating position.

3. The apparatus defined in claim 2, further comprising detent means for releasably retaining said sleeve in said operating position.

4. The apparatus defined in claim 3 wherein said sleeve is formed with a recess, said detent means including a ball carried on said support and engageable in said recess and a spring pressing said ball toward said sleeve.

5. The apparatus defined in claim 2 wherein said means for displacing includes a toggle linkage having a pair of stable end positions corresponding to said operating and rest positions and an intermediate metastable position.

6. The apparatus defined in claim 5 wherein said linkage includes a lever carried on said sleeve and extending radially therefrom and a compression spring between said lever and said support and arranged for maximum compression in said metastable position and lesser compression in said end positions.

7. The apparatus defined in claim 6, further comprising spinning means for pulling a filament off a yarn package carried on said spindle and winding said filament up, and mechanism connected between said sleeve and said support and responsive to the occurence of a predetermined condition in said spinning means for displacing said sleeve into said rest position.

8. The apparatus defined in claim 7 wherein said mechanism is also responsive to the occurence of another condition for displacing said sleeve into said operating position.

9. The apparatus defined in claim 7 wherein said mechansim includes a solenoid.

10. The apparatus defined in claim 9 wherein said mechanism includes two oppositely acting solenoids.

11. The apparatus defined in claim 7 wherein said mechanism includes a fluid-operated cylinder.

12. The apparatus defined in claim 7 wherein said spinning means includes means for detecting a thread break, same being the occurrence to which said mechanism responds.

13. The apparatus defined in claim 7 wherein said spinning means includes a spool for winding up said filament and means for detecting when said spool is fully wound, said mechanism responding when said spool is fully wound.

14. The apparatus defined in claim 1, further comprising a detent engageable with said linkage for locking said sleeve in said rest position, and spring means for urging said sleeve into said operating position.

15. The apparatus defined in claim 14, further comprising means for detecting the tension in a filament pulled off said package and connected to said detent for releasing said sleeve when said tension drops below a predetermined limit.

16. The apparatus defined in claim 15 further comprising a lost-motion coupling between said means for detecting and said detent.

17. The apparatus defined in claim 16 wherein said means for detecting includes a pivotal arm having one end resting on said filament and another end connected to said coupling.

18. The apparatus defined in claim 1, further comprising brake means effective only with said sleeve in said rest position to arrest said spindle on said support.

19. The apparatus defined in claim 18 wherein said brake means includes at least one brake shoe operatively engageable with said spindle, spring means normally urging said shoe into braking engagement with said spindle, and means for holding said shoe away from said spindle except when said sleeve is in said rest position.

20. The apparatus defined in claim 19 wherein a pair of such brake shoes are pivoted on one side of said spindle on said suport and surround said spindle, said shoes having ends opposite their pivoted ends separable by said means for holding.

* * * * *